US008789912B2

(12) United States Patent
Yamada et al.

(10) Patent No.: US 8,789,912 B2
(45) Date of Patent: Jul. 29, 2014

(54) INKJET RECORDING HEAD

(75) Inventors: Kazuhiro Yamada, Yokohama (JP); Ryohei Goto, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 41 days.

(21) Appl. No.: 13/537,472

(22) Filed: Jun. 29, 2012

(65) Prior Publication Data

US 2013/0010027 A1 Jan. 10, 2013

(30) Foreign Application Priority Data

Jul. 4, 2011 (JP) ..... 2011-148374

(51) Int. Cl.
*B41J 29/38* (2006.01)
*B41J 2/155* (2006.01)
*B41J 2/14* (2006.01)

(52) U.S. Cl.
CPC ..... *B41J 2/1408* (2013.01); *B41J 2202/21* (2013.01)
USPC ..... 347/17; 347/42

(58) Field of Classification Search
USPC ..... 347/17, 18
See application file for complete search history.

(56) References Cited

U.S. PATENT DOCUMENTS

| | | | | |
|---|---|---|---|---|
| 6,254,214 | B1 * | 7/2001 | Murthy et al. | 347/17 |
| 2003/0071865 | A1 * | 4/2003 | Mott et al. | 347/18 |
| 2005/0274501 | A1 * | 12/2005 | Agee | 165/146 |
| 2009/0002407 | A1 * | 1/2009 | Karin et al. | 347/17 |
| 2009/0141063 | A1 * | 6/2009 | Takano et al. | 347/18 |
| 2009/0141064 | A1 * | 6/2009 | Shihoh et al. | 347/18 |
| 2011/0279545 | A1 * | 11/2011 | Osaki et al. | 347/44 |
| 2013/0208053 | A1 * | 8/2013 | Iwanaga et al. | 347/61 |

FOREIGN PATENT DOCUMENTS

JP 2007-168112 A 7/2007

* cited by examiner

*Primary Examiner* — Shelby Fidler
(74) *Attorney, Agent, or Firm* — Canon USA Inc IP Division

(57) ABSTRACT

An inkjet recording head includes plural element substrates and a coolant flow channel. Each of the plural element substrates is provided with an ejection port surface and plural energy generating elements. The coolant flow channel is provided with a first heat transfer portion overlapping, in a direction vertical to the ejection port surface, a central portion of each of the element substrates in a direction in which the plural energy generating elements are arranged, and a second heat transfer portion overlapping, in the vertical direction, an area between the plural element substrates which adjoin in the arranged direction. The first heat transfer portion and the second heat transfer portion are provided with recesses or projections, and arrangement density of the recesses or the projections of the first heat transfer portion being greater than that of the second heat transfer portion.

9 Claims, 8 Drawing Sheets

INKJET RECORDING HEAD

BACKGROUND OF THE INVENTION

1. Field of the Invention

The present disclosure relates to an inkjet recording head which carries out recording by ejecting ink.

2. Description of the Related Art

Recently, inkjet recording apparatus, which was typically intended for home use, has been applied to a wide variety of fields; inkjet recording apparatus is used in offices or for retail photographing in the business field and used for drawing electronic circuits and manufacturing flat panel displays in the industrial field. In this trend, there is a demand that the inkjet recording apparatus has an increasingly higher recording speed. Some measures have been taken to meet the demand: for example, increasing driving frequency of an energy generating element used for the ejection of ink, and employing a linear head of which width of the inkjet recording head (hereinafter, "head") is longer than the width of a recording medium.

However, if driving frequency of the energy generating element is increased to meet the demand for a higher speed, density of power supplied to the head becomes high. Especially in an ejection system in which the ink is heated and made to boil and then ejected using the bubble generating energy, an increase in power density causes a greater increase in temperature of the head and, as a result, affects image quality. This is because an increase in head temperature causes an increase in ink temperature, and the increased ink temperature causes a fluctuation in the amount of the ink to be ejected; and therefore, recording density varies between the beginning of recording and the rest of time during the recording. In an ejection system in which a piezoelectric element is used, an increase in ink temperature caused by the ejection of the ink is not significant and, therefore, an influence on image quality by the increased density of supplied power is relatively small. The ejection system in which a piezoelectric element is used has the following problem. If the ink is ejected using shear strain (i.e., shear mode) of the piezoelectric element, energy efficiency for the ejection is low and an increase in ink temperature is large; therefore, image quality is easily affected.

Besides the influence on image quality caused by the increase in head temperature, distribution of temperature along a longitudinal direction of the recording element substrate may cause varied density in an image along the longitudinal direction of the recording element substrate. This is because heat tends to accumulate at the central portion and tends to be lost at end portions along the longitudinal direction of the recording element substrate.

Japanese Patent Laid-Open No. 2007-168112 proposes, as illustrated in FIG. 7 thereof, a configuration to address the above-described problem. In the proposed configuration, a coolant flow channel is provided such that a coolant flow channel (in particular, liquid cooling pipes 15 and 16) as the coolant flow channel overlaps the central portion of a recording element substrate along a direction vertical to an ejection port surface of the recording element substrate.

However, it is still difficult by the configuration described in Japanese Patent Laid-Open No. 2007-168112 to sufficiently reduce difference in temperature between the central portion and the end portions along the longitudinal direction of the recording element substrate. Especially during high-speed recording, the amount of heat generated in each recording element substrate is large and therefore the problem regarding the difference in temperature of the recording element substrate becomes noticeable.

SUMMARY OF THE INVENTION

The present disclosure provides an inkjet recording head which is capable of avoiding reduction in image quality caused by difference in temperature. The inkjet recording head has a configuration in which difference in temperature of a recording element substrate between a central position and end positions along a direction in which recording elements are arranged is small.

According to an aspect disclosed herein, an inkjet recording head is provided, which includes: plural element substrates each provided with an ejection port surface on which plural ejection ports are formed, through which ink is ejected, and plural energy generating elements which produce energy to eject the ink through the plural ejection ports; and a coolant flow channel provided in the element substrates on a reverse side of the ejection port surface and in which a coolant, for cooling the plural element substrates, flows, the coolant flow channel including a first heat transfer portion and a second heat transfer portion, the first heat transfer portion being located on the side of the element substrates and overlapping along a direction vertical to the ejection port surface, a central portion of each of the element substrates along a direction in which the plural energy generating elements are arranged, and a second heat transfer portion being located on the side of the element substrates and overlapping along the direction vertical to the ejection port surface, an area between the plural element substrates which adjoin along the direction the plural energy generating elements are arranged, wherein the first heat transfer portion and the second heat transfer portion are provided with recesses toward a surface on the side of the element substrates, of a wall which forms the coolant flow channel, or projections protruding toward the surface on the side of the element substrates, and an arrangement density of the recesses or the projections provided in the first heat transfer portion being greater than an arrangement density of the recesses or the projections provided in the second heat transfer portion.

Further features will become apparent from the following description of exemplary embodiments with reference to the attached drawings.

DESCRIPTION OF THE EMBODIMENTS

Hereinafter, embodiments of the present disclosure will be described with reference to the drawings. Although bubble generating energy is used in an ejection system of the present embodiment, a piezoelectric element and, especially, a shear mode may also be used in the ejection system.

Inkjet Recording Head

Figure 1A:
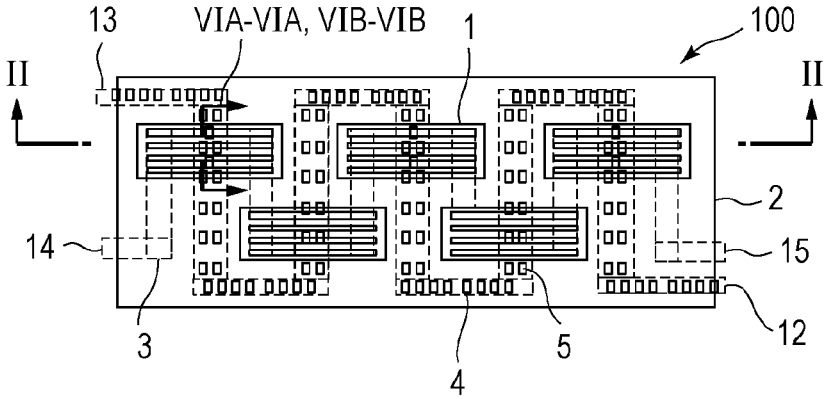
FIG. 1A is a schematic diagram of a structure of an inkjet recording head representing a first embodiment.
Figure 2:
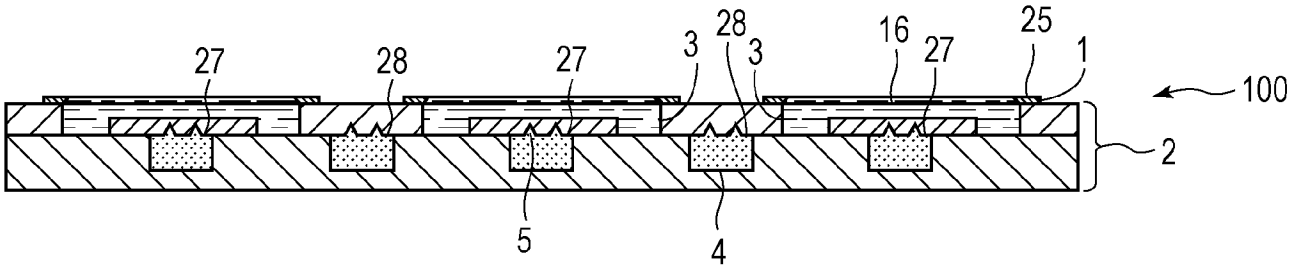
FIG. 2 is a cross-sectional view along line II-II of FIG. 1A.

FIG. 1A is an exemplary embodiment as disclosed herein, and illustrates an exemplary configuration of a linear head in which plural recording element substrates 1 are arranged. FIG. 2 is a cross-sectional view along line II-II of FIG. 1A. An inkjet recording head 100 (hereinafter, "head") includes plural recording element substrates 1 which are arranged on a support base 2 of the head 100 in an staggered pattern along a longitudinal direction.

The arrangement pattern of the recording element substrates 1 is not limited to the staggered pattern. For example, the recording element substrates 1 may be arranged linearly or arranged in an inclined manner at a predetermined angle along a longitudinal direction of the head 100. Although plural recording element substrates 1 are illustrated in FIG. 1A, the number of the recording element substrates 1 is not limited to the same: for example, only a single recording element substrate 1 may be provided.

Figure 3:
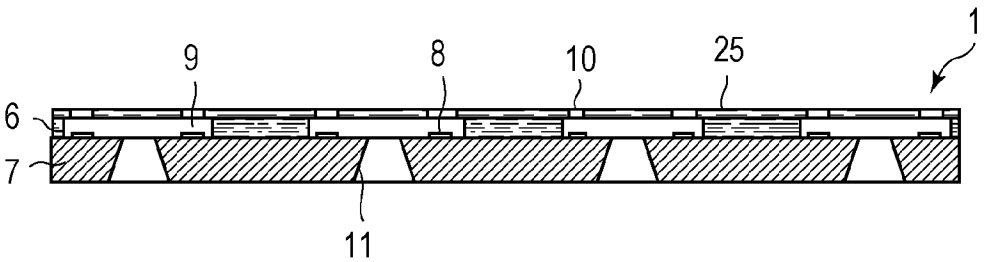
FIG. 3 illustrates a cross section of a recording element substrate along a width direction.

FIG. 3 illustrates a cross section of a recording element substrate 1 along a width direction thereof. The recording element substrate 1 consists of an ejection port member 6 and a heating element substrate 7 which are joined together. The ejection port member 6 is provided with bubble generating chambers 9 and ejection ports 10 through which ink is ejected. The ejection port member 6 of the present embodiment includes eight ejection port arrays in each of which ejection ports 10 are arranged. Heating elements 8 are provided in the heating element substrate 7 at positions to correspond to the bubble generating chambers 9. The heating elements 8 are energy generating elements which generate energy to cause the ink to be ejected. Ink supply ports 11 are formed in the heating element substrate 7. The ink is supplied to the bubble generating chambers 9 through the ink supply ports 11.

Electrical wiring (not illustrated) is formed inside the heating element substrate 7. The electrical wiring is electrically connected to a lead electrode of a flexible printed circuit board disposed on the support base 2, or connected to an electrode provided inside the support base 2. Pulse voltage is input in the heating element substrate 7 from a control circuit provided outside the head 100. The input pulse voltage drives the heating elements 8 to cause the ink contained in the bubble generating chambers 9 to boil and then, ink droplets are ejected through the ejection ports 10.

In the present embodiment, a longitudinal direction of the recording element substrate 1 corresponds to a direction in which the heating elements 8 are arranged, and a width direction of the recording element substrate 1 corresponds to a direction vertical to the direction in which the heating elements 8 are arranged, along the direction of an ejection port surface 25 on which the ejection ports 10 are provided.

As illustrated in FIGS. 1A and 2, an ink supply channel 3 is formed in the support base 2. The ink flows in the ink supply channel 3 and is supplied to the recording element substrates 1. An ink inlet port 14 through which the ink flows in is provided at one end of the ink supply channel 3, and an ink outlet port 15 through which the ink is discharged is provided at the other end of the ink supply channel 3. The ink is supplied to each of the ink supply ports 11 through each of slits 16. The slits 16 are formed in the ink supply channel 3 such that each slit 16 faces each of the ink supply ports 11.

It is desirable that the support base 2 is made of a material which has a low coefficient of thermal expansion and high heat conductivity because heat is transferred to the support base 2 from the recording element substrates 1. It is also desirable that the support base 2 has enough rigidity against deformation of the linear head and has sufficient corrosion resistance to the ink. For example, it is desirable that the support base 2 is made of aluminum oxide or silicon carbide. From the viewpoint of cooling efficiency, silicon carbide is more suitable because of its high thermal conductivity. In the present embodiment, the support base 2 consists of two planar members which are joined together.

In the configuration illustrated in FIG. 1A, the ink supply channel 3 runs in a winding manner and the alternately-arranged plural recording element substrates 1 are sequentially supplied with the ink. However, the configuration of the ink supply channel 3 is not limited to the same. For example, one linear ink supply channel 3 may be formed for each of two arrays of the recording element substrates 1 which are arranged linearly in the head 100 along the longitudinal direction. The thus-formed ink supply channels 3 are connected to each other at end portions of the head 100 along the longitudinal direction. It is desired that the length of the ink supply channel 3 is short. This is because large pressure loss is caused in a longer ink supply channel 3 and, therefore, the ink is not properly supplied to the recording element substrates 1 that are located downstream of the ink supply channel 3.

Although the ink is supplied to plural recording element substrates 1 from a single ink supply channel 3 in the present embodiment, the ink may be supplied to each recording element substrate 1 independently from an ink supply channel 3 provided therefor.

In the present embodiment, the ink supply channel 3 is connected to an external ink circulation channel, and the ink flowing out through the ink outlet port 15 flows in the ink inlet port 14 again via a heat exchanger and a circulator. This configuration enables the head 100 to be cooled by the ink flowing through the ink supply channel 3. If an amount of heat generated in the recording element substrates 1 is small, such as during a low speed recording, the ink outlet port 15 may be closed or the ink may be supplied through the ink outlet port 15.

As illustrated in FIGS. 1A and 2, a coolant (i.e., a coolant) for cooling the recording element substrates 1 flows in a coolant flow channel 4. The coolant flow channel 4 is formed inside the support base 2, on the reverse side of each ejection port surface 25 of the recording element substrates 1. A coolant inlet port 12 through which the coolant flows in is provided at one end of the coolant flow channel 4, and a coolant outlet port 13 through which the coolant flows out is provided at the other end of the coolant flow channel 4. The coolant outlet port 13 is connected to an external coolant circulation channel. The coolant flowing out through the coolant outlet port 13 flows in the coolant inlet port 12 again via a heat exchanger and a circulator.

As illustrated in FIGS. 1A and 2, the coolant flow channel 4 runs inside the head 100 in a winding manner.

In particular, the coolant flow channel 4 overlaps the longitudinal-direction central portion of each recording element substrate 1 along a direction vertical to each ejection port surface 25, and intersects the recording element substrate 1 along a width direction of the recording element substrate 1 at that central portion. The coolant flow channel 4 does not overlap longitudinal-direction end portions of each recording element substrate 1 along the direction vertical to each ejection port surface 25, and runs through an area between recording element substrates 1 which are adjacent to each other along the longitudinal direction thereof.

Since the coolant flow channel 4 is thus configured, the ends portions of each recording element substrate 1 at which heat tends to be lost are located farther away from the coolant flow channel 4 than the central portion of the recording element substrate 1 at which heat tends to accumulate. Therefore, heat tends to radiate easily at the central portion of the recording element substrate 1 and, therefore, difference in temperature of the recording element substrate 1 along the longitudinal direction may be reduced.

In the present embodiment, the ink inlet port 14 of the ink supply channel 3 and the coolant outlet port 13 of the coolant flow channel 4 are provided at one end of the head 100, and the ink outlet port 15 of the ink supply channel 3 and the coolant inlet port 12 of the coolant flow channel 4 are provided at the other end of the head 100. This means that the liquid in the ink supply channel 3 and the liquid in the coolant flow channel 4 are flowing in the opposite direction along the longitudinal direction of the head 100. Therefore, the coolant which has flowed inside the head 100 and has increased in temperature flows near the ink inlet port 14 at which ink temperature is low, and the ink which has increased in temperature inside the head 100 flows near the coolant inlet port 12. This configuration may reduce the difference in temperature along the longitudinal direction of the head 100 as compared with a configuration in which the ink and the coolant flow in the same direction along the longitudinal direction of the head 100.

First Embodiment

Figure 6A:
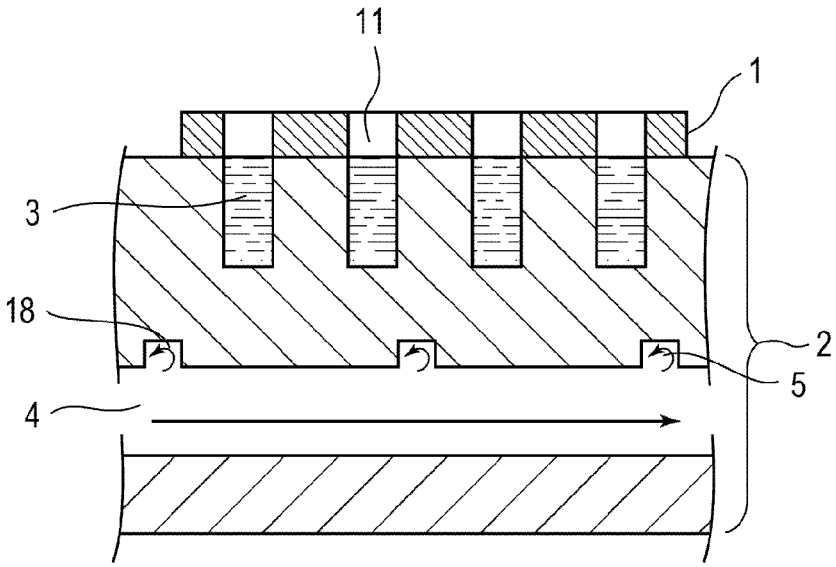
FIG. 6A is a cross-sectional view along line VIA-VIA of FIG. 1A.

As illustrated in FIGS. 1A and 2, in the inkjet recording head 100 of the first embodiment, heat-transfer accelerating members 5 are provided in the coolant flow channel 4 on the side of the recording element substrates 1. As illustrated in FIG. 2, each heat-transfer accelerating member 5 has a triangular cross section along the longitudinal direction of the recording element substrates 1 in the present embodiment. Each heat-transfer accelerating member 5 is a fine recess which is recessed toward the recording element substrates 1 with respect to a surface of a wall which forms the coolant flow channel 4 on the side of the recording element substrates 1. The heat-transfer accelerating members 5, which are recesses, expand an area in which the coolant and the support base 2 are in contact with each other and facilitate the occurrence of a vortex in the coolant flow due to a vortex occurring in the flow of the coolant within the recesses. Therefore, heat transfer from the heat transfer surface to the coolant is accelerated. As schematically illustrated in FIG. 6A which is a VIA-VIA cross-sectional view of FIG. 1A, vortexes occur in the coolant as illustrated by arrows 18 in the recesses.

The size of each recess is desirably determined in consideration of flowing speed of the coolant. A suitable size of the recess is as follows: the opening diameter is about 100 to 1000 micrometers and the depth is about 100 to 1000 micrometers.

If the opening diameter is smaller than 100 micrometers, loss of the pressure which causes the coolant to flow in the recess is excessively large and, therefore, movement of the coolant within the recess is less easily produced. As a result, an effect of accelerating heat transfer is reduced. If the opening diameter is larger than 1000 micrometers, the size of the recess is excessively large with respect to the size of each recording element substrate (width direction length: 10 to 15 mm and longitudinal direction length: 20 to 40 mm) and, therefore, the number of recesses that may be provided in the coolant flow channel 4 is decreased.

If the depth of the recess is small, the heat transfer area is also small and a boundary layer of the flow of the coolant is formed along the recess. As a result, the effect of accelerating heat transfer caused by the vortex in the coolant flow is reduced. The maximum depth of the recess is determined in consideration of the opening diameter of the recess. If the depth is excessively large with respect to the opening diameter, the coolant less easily moves at the bottom of the recess. The effect of the accelerating heat transfer is therefore reduced. For these reasons, the desirable size of the recess is in the above-given range.

Figure 6B:
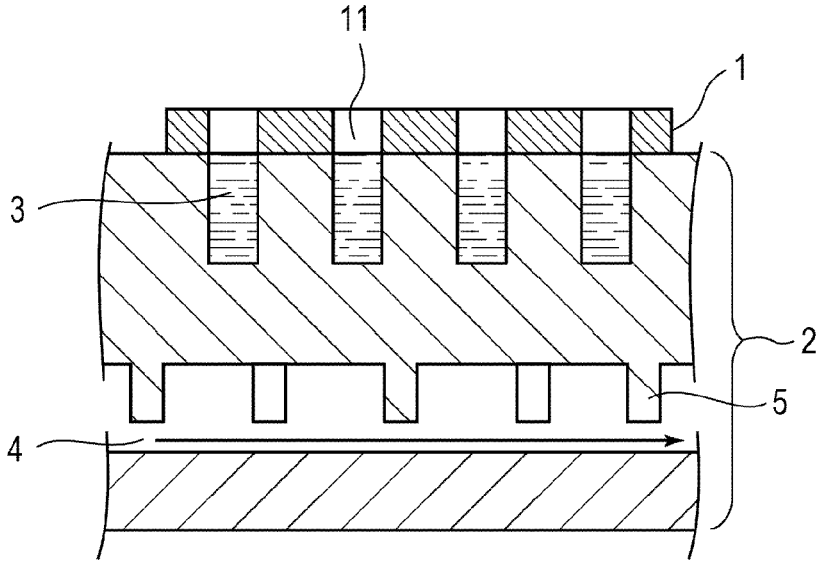
FIG. 6B is a cross-sectional view along line VIB-VIB of FIG. 1A in a case in which a heat-transfer accelerating member is formed as projections.

The recess as the heat-transfer accelerating member 5 is triangular in cross section along the longitudinal direction of the recording element substrate 1 and is rectangular in cross section along the width direction in FIGS. 1A and 2. However, the recess may have other shapes as long as being capable of expanding the heat transfer area and causing a vortex in the coolant flow. For example, the shape of the recess may be cylindrical, conical, prismatic, or pyramid. The heat-transfer accelerating member 5 may be shaped as, for example, a rectangular groove, a V-shaped groove or a U-shaped groove, such that the recesses extend in a direction which intersects the flow of the coolant. As illustrated in FIG. 6B, the heat-transfer accelerating member 5 may be a projection protruding toward the coolant flow channel 4 side with respect to the surface of the wall which forms the coolant flow channel 4. In a case in which the heat-transfer accelerating member 5 is shaped as a projection, an area having a high heat transfer coefficient may be created locally near the projection by a collision effect produced when the coolant collides with the heat-transfer accelerating member 5. Therefore, together with the effects of expanding the heat transfer area and accelerating the occurrence of the vortex in the coolant flow, a cooling effect higher than that in the case in which the heat-transfer accelerating member 5 is shaped as a recess is produced.

From the viewpoint of the heat transfer effect, the projection is more desirable than the recess. If the support base 2 is made of a ceramic material, such as aluminum oxide and silicon carbide, the recess is desirable from the viewpoint of workability, cost and rigidity.

In the inkjet recording head 100 of the first embodiment, as illustrated in FIG. 1A, the heat-transfer accelerating members 5 are provided in the coolant flow channel 4 on the side of the recording element substrate 1 so that arrangement density of the heat-transfer accelerating members 5 is varied. In particular, the arrangement density of the heat-transfer accelerating members 5 provided in a first heat transfer portion 27 of the coolant flow channel 4 which overlaps the central portion of the recording element substrate 1 is higher than the arrangement density of the heat-transfer accelerating members 5 provided in a second heat transfer portion 28 of the coolant flow channel 4 which overlaps an area between adjoining recording element substrates 1.

Here, a portion of the coolant flow channel 4 located on the side of the recording element substrates 1 which overlaps the longitudinal-direction central portion of the recording element substrate 1 along a direction vertical to the ejection port surface 25 is referred to as the first heat transfer portion 27. A portion of the coolant flow channel 4 located on the side of the recording element substrates 1 which overlaps, in the direction vertical to the ejection port surface 25, an area between plural recording element substrates 1 which adjoin along the longitudinal direction of the recording element substrates 1 is referred to as the second heat transfer portion 28.

In this configuration, heat transfer to the coolant is accelerated more actively in the first heat transfer portion 27 than in the second heat transfer portion 28. Therefore, an effect of heat radiation from the central portion is accelerated more actively than in the end portions of each recording element substrate 1. As a result, difference in temperature between the central portion and the end portions of each recording element substrate 1 along the longitudinal direction is reduced.

In the present embodiment, the heat-transfer accelerating members 5 are provided also in the area located in the coolant flow channel 4 on the side of the recording element substrates 1 other than the first heat transfer portion 27 and the second heat transfer portion 28 (a "third heat transfer portion"). If the temperature of the entire head 100 is required to be low, it is desirable to provide the heat-transfer accelerating members 5 in the entire area of the coolant flow channel 4 as described in the present embodiment. The coolant flowing in the coolant flow channel 4 is heated in the flowing direction of the coolant. Therefore, in order to reduce the difference in temperature of the head 100 along the longitudinal direction, it is desirable to provide the heat-transfer accelerating members 5 such that the arrangement density of the heat-transfer accelerating members 5 is higher in the upstream than in the downstream of the coolant flow channel 4.

In the present embodiment, there is a portion at which the coolant flow channel 4 exists near one end of the recording element substrate 1 located at the longitudinal-direction ends of the head 100 other than the portion between recording element substrates 1 which adjoin to each other. In the portion located in the coolant flow channel 4 on the side of the recording element substrates 1 which overlaps near the longitudinal-direction end of the recording element substrate 1 along the direction vertical to the ejection port surface 25, it is desirable that the arrangement density of the heat-transfer accelerating members 5 in the first heat transfer portion 27 is lowered as in the second heat transfer portion 28. Therefore, an effect of heat radiation from the central portion is accelerated more actively than in the end portions of each recording element substrate 1. As a result, it is possible to further reduce the difference in temperature between the central portion and the end portions of each recording element substrate 1 along the longitudinal direction.

Second Embodiment

Figure 1B:
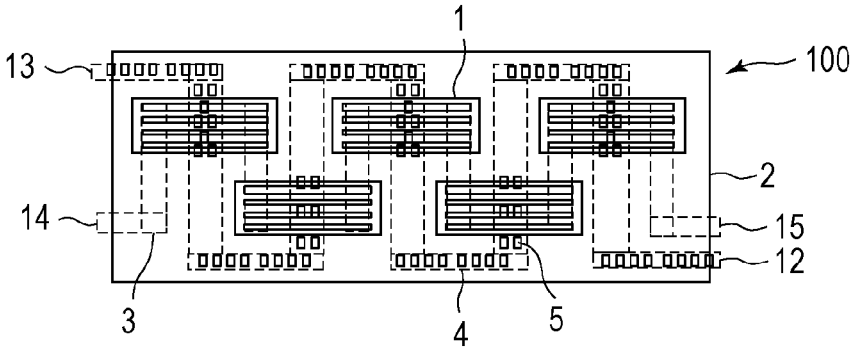
FIG. 1B is a schematic diagram of a structure of an inkjet recording head representing a second embodiment.

FIG. 1B illustrates an inkjet recording head 100 of a second embodiment. In the second embodiment, the heat-transfer accelerating members 5 are not provided in the coolant flow channel 4 at a portion near longitudinal-direction end portions of each recording element substrate 1 in the configuration of FIG. 1A. With the thus-arranged heat-transfer accelerating members 5, the effect of accelerating heat transfer of the coolant flow channel 4 is increased and, at the same time, the effect of heat radiation from the central portion is accelerated more actively than in the end portions of each recording element substrate 1. As a result, it is possible to reduce the difference in temperature between the central portion and the end portions of each recording element substrate 1 along the longitudinal direction.

Third Embodiment

Figure 1C:
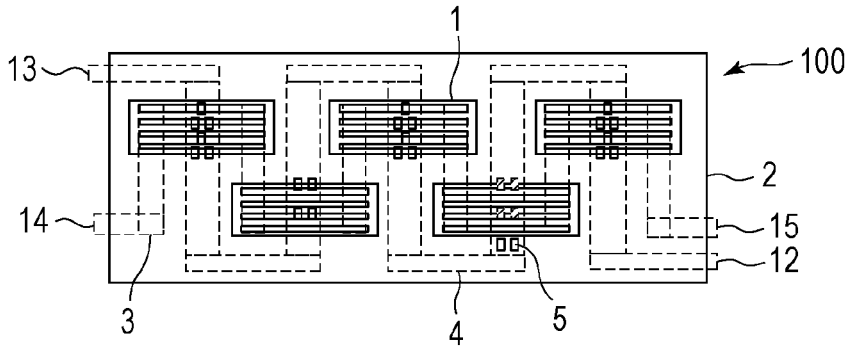
FIG. 1C is a schematic diagram of a structure of an inkjet recording head representing a third embodiment.

FIG. 1C illustrates an inkjet recording head 100 of a third embodiment. In the third embodiment, the heat-transfer accelerating members 5 are provided only in the first heat transfer portion 27. With the thus-arranged heat-transfer accelerating members 5, the effect of heat radiation from the central portion is accelerated more actively than in the end portions of each recording element substrate 1. As a result, it is possible to reduce the difference in temperature between the central portion and the end portions of each recording element substrate 1 along the longitudinal direction.

Fourth Embodiment

Figure 1D:
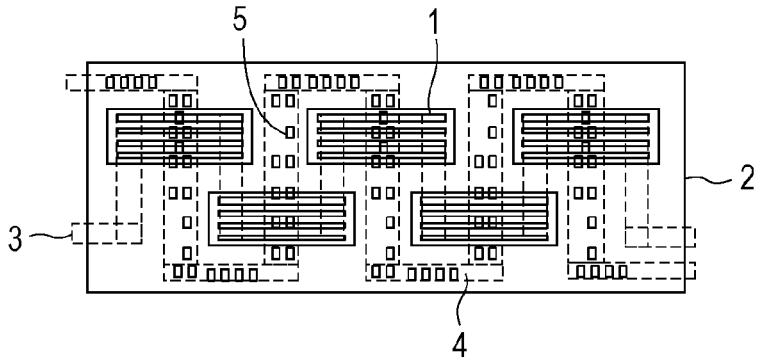
FIG. 1D is a schematic diagram of a structure of an inkjet recording head representing a fourth embodiment.
Figure 4:
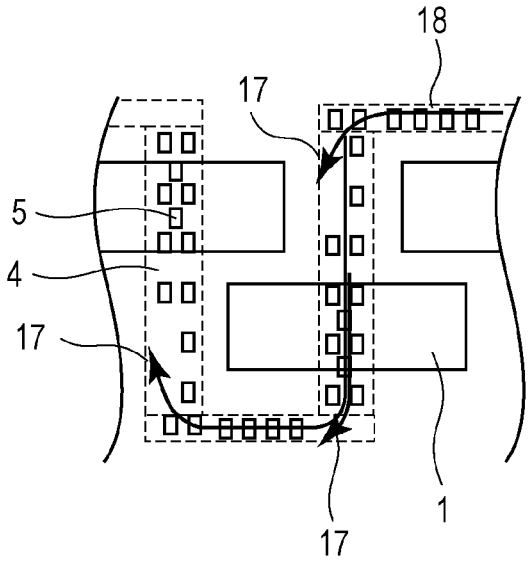
FIG. 4 illustrates a fourth embodiment.

FIG. 1D illustrates an inkjet recording head 100 of a fourth embodiment. As illustrated in FIG. 4, which is a partially enlarged view of FIG. 1D, in winding portions at which the coolant flow channel 4 is wound, the coolant flows so as to collide with a wall which forms the coolant flow channel 4. It is known that the collision of the coolant with the wall of the coolant flow channel 4 accelerates heat transfer between the wall and the coolant. Therefore, there is a possibility that the recording element substrate 1 located near a colliding portion 17 at which the coolant collides with the wall is partially cooled excessively.

In particular, as illustrated in FIG. 4, the coolant tends to collide with an outside wall of the winding portion at a position near the downstream of a direction in which the coolant flows in the winding portion of the coolant flow channel 4. Therefore, in the present embodiment, no heat-transfer accelerating member 5 is provided outside the winding portion at a position near the downstream of the winding portion. At the position near the downstream of the winding portion, arrangement density of the heat-transfer accelerating members 5 is lower in the outside of the winding portion than in the inside of the winding portion. In this configuration, a cooling effect by the collision of the coolant at the position near the colliding portion 17 is reduced, and therefore it is possible to reduce an increase in difference in temperature in the recording element substrate 1. As described above, heat is easily lost at the end portions of the recording element substrate 1. It is therefore desirable that the arrangement density of the heat-transfer accelerating members 5 is different between the outside and the inside of the winding portion especially in the second heat transfer portion 28 which overlaps the area between the recording element substrates 1 which adjoin to each other.

The "arrangement density of the heat-transfer accelerating members 5" in the embodiment described above refers to the number of heat-transfer accelerating members 5 formed per unit area. The smaller the size of the heat-transfer accelerating member 5, the higher the arrangement density. The larger the distance between the heat-transfer accelerating members 5, the lower the arrangement density.

Typical heat coolants may be used as the coolant: especially desirable coolant is water, which is advantageous in specific heat and heat transfer efficiency and is harmless to the outside environment.

Variance in Temperature in Inkjet Recording Head and in Recording Element Board

Hereinafter, operations of the inkjet recording heads 100 illustrated in FIGS. 1A to 1D and 5 when being driven and distribution of temperature in the inkjet recording head 100 and in the recording element substrate 1 will be described.

Figure 5:
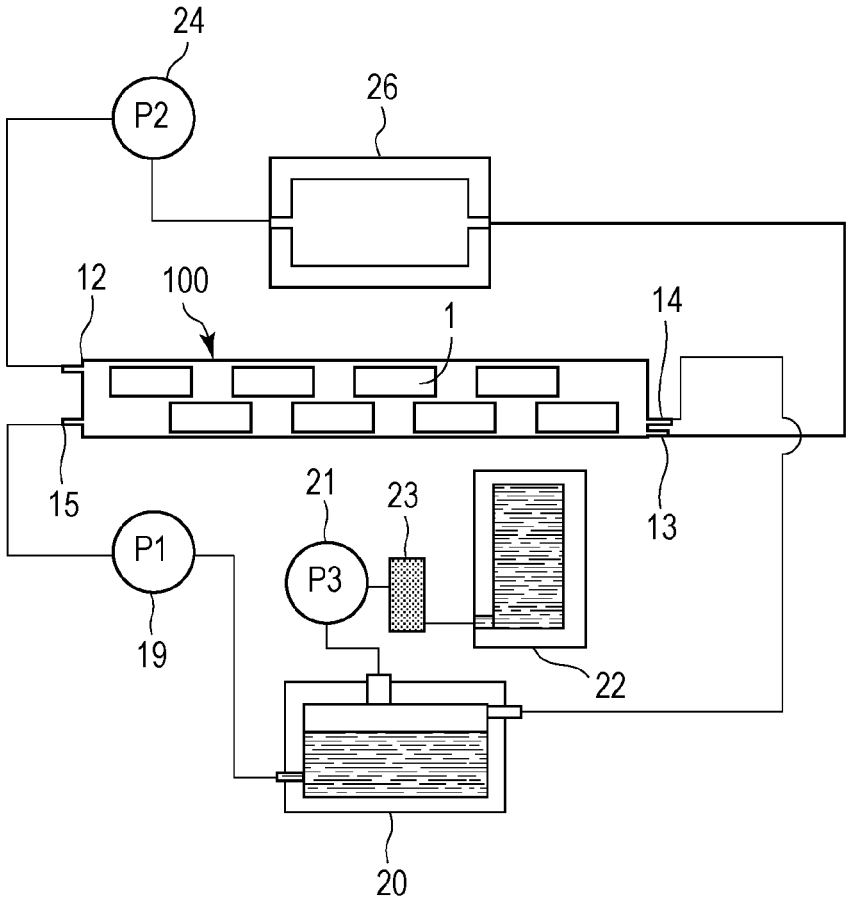
FIG. 5 is a schematic diagram of a connecting structure for causing ink and a coolant to flow into the inkjet recording head.

As illustrated in FIG. 5, in the inkjet recording head 100, a tube connected to an ink tank 20 is connected to the ink inlet port 14, and a tube connected to a negative pressure producing pump 19 is connected to the ink outlet port 15. The ink tank 20 is connected to a heat exchanger (not illustrated). The ink tank 20 supplies ink to the head 100 and cools the ink which has been circulated through the pump 19. The ink of which a foreign substance has been removed by a filter 23 may be transported from an ink cartridge 22 to the ink tank 20 by the pump 21. The ink may be supplied to the ink tank 20 in the same amount as that ejected from the head 100 by the recording. The ink tank 20 is provided with a port for ambient air ventilation, through which air bubbles in the ink escape.

A tube connected to a coolant pump 24 is connected to the coolant inlet port 12, and a tube connected to a coolant heat exchanger 26 is connected to the coolant outlet port 13.

When the ink is ejected through the ejection ports 10, remaining heat of the heating element 8 is transferred to the ink and the recording element substrates 1, and then transferred to the support base 2. Therefore, temperature of the entire inkjet recording head 100 rises. At this time, the negative pressure producing pump 19 and the coolant pump 24 are made to operate and thereby the ink and the coolant are made to circulate within the inkjet recording head 100. Then heat is transferred to the ink from the support base 2 and the recording element substrates 1 in the head 100, and to the coolant from the support base 2 so that the head 100 is cooled.

The ink takes heat from each of the recording element substrates 1 and flows in the ink supply channel 3 from the upstream to the downstream while the temperature of the ink supply channel 3 rises. In this configuration, the further the recording element substrate 1 toward the downstream of the ink supply channel 3, the smaller the difference in temperature between the recording element substrate 1 and the ink, and the further the recording element substrate 1 toward the downstream of the ink supply channel 3, the smaller the amount of heat to be transferred to the ink.

The heat transferred to the support base 2 from the recording element substrates 1 is transferred to the ink only partially and most of the heat is transferred to the coolant. Thus, the coolant flows downstream while the temperature thereof rises in the same manner as in the ink. However, since the flow rate of the coolant is significantly higher than that of the ink, temperature rise of the coolant may be reduced and temperature rise of the recording element substrate 1 located downstream of the coolant flow channel 4 is prevented. The heat is transferred to the coolant from the recording element substrates 1 via the support base 2 whereas the heat is transferred to the ink directly from the recording element substrate 1. Therefore, in the linear head, the temperature of the recording element substrate 1 located at the most upstream of the ink supply channel 3 tends to be lower than that of the recording element substrate 1 located at the most downstream of the ink supply channel 3.

However, in a configuration in which the support base 2 is made of a highly thermally conductive material and the coolant is made to flow in the direction opposite to the direction in which the ink flows as illustrated in FIG. 1A, in the recording element substrate 1 located at the most downstream of the ink supply channel 3, there is a possibility that the highest temperature and the lowest temperature of the plural recording element substrates 1 appear. This is because, among the recording element substrates 1 arranged on the support base 2, the recording element substrate 1 located at the most downstream of the ink supply channel 3 is cooled by the coolant at the lowest temperature thereof whereas is in contact with the ink at the highest temperature thereof.

As described above, distribution of temperature in the recording element substrate 1 is as follows: the temperature is high in the central portion at which heat tends to accumulate and is low in the end portions at which the heat tends to be lost. Especially, the difference in temperature along a print width direction, i.e., the longitudinal direction of the recording element substrate 1 tends to affect the image quality. Variance of temperature in the longitudinal direction of the recording element substrate 1 is as follows: the temperature is high in the central portion and low in the end portions and, regarding the end portions, the temperature of the upstream end portion of the ink supply channel 3 at which the ink of low temperature flows in is lower than the temperature of the downstream end portion.

Figure 7:
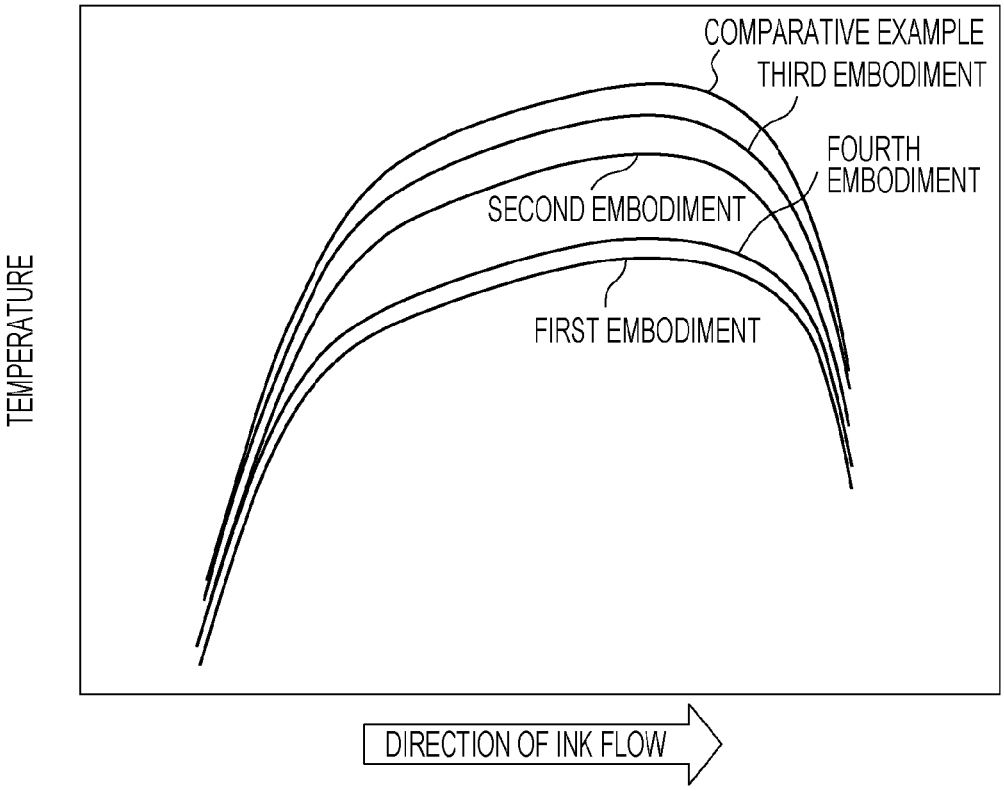
FIG. 7 illustrates a distribution of temperature, along a longitudinal direction, in the recording element substrate, which is disposed at the most downstream position in an ink flow.
Figure 8:
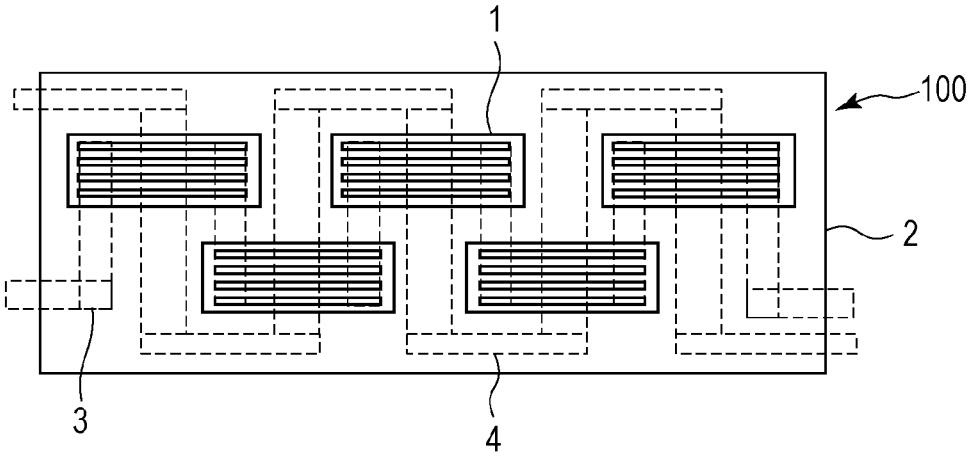
FIG. 8 illustrates a Comparative Example.

FIG. 7 schematically illustrates the distribution of temperature in the recording element substrate 1 located at the most downstream of the ink flow in the inkjet recording head 100 of the embodiments described above. Comparative Example is a configuration in which no heat-transfer accelerating member 5 is provided in the coolant flow channel 4 as illustrated in FIG. 8. As compared with Comparative Example, the temperature of the recording element substrate 1 at the central portion and at the end portions is low in the third embodiment. An amount of decrease in temperature at the central portion is larger than at the end portions of the recording element substrate 1 as compared with Comparative Example. Therefore, difference in temperature within the recording element substrate 1 is smaller in the third embodiment than in Comparative Example.

In the second embodiment, since the number of the heat-transfer accelerating members 5 in the coolant flow channel 4 is larger than that of the third embodiment, the recording element substrates 1 are cooled in an accelerated manner. The second embodiment is not so much different from the third embodiment regarding the difference in temperature in the recording element substrate 1. However, since the entire temperature of the recording element substrate 1 of the second embodiment is lower than that of the third embodiment, the highest temperature of the recording element substrate 1 is low. In the first embodiment and the fourth embodiment, since the number of the heat-transfer accelerating members 5 is even larger than in the second embodiment, the highest temperature of the recording element substrate 1 is low.

Examples

Hereinafter, the effects of the above-described embodiments will be described with reference to Examples and Comparative Example.

Regarding Example 1 and Example 2, numerical analysis simulation is carried out under the condition shown in Table 1. The inkjet recording head 100 illustrated in FIG. 1C is used in Example 1. The inkjet recording head 100 illustrated in FIG. 1D is used in Example 2. As Comparative Example, simulation is carried out under the condition shown in Table 1 using the inkjet recording head 100 illustrated in FIG. 8. In Comparative Example, the heat-transfer accelerating members 5 are not provided in the coolant flow channel 4.

TABLE 1

| | |
|---|---|
| Supplied power per recording element substrate (W) | 45 |
| Driving frequency (kHz) | 37.8 |
| Amount of ink ejected per ejection port (pL) | 2.8 |
| Discharge rate per recording element substrate (mL/min) | 12.25 |
| Flow rate of ink circulation (mL/min) | 25 |
| Ink supply temperature (° C.) | 22 |
| Refrigerant flow rate (mL/min) | 1000 |
| Refrigerant supply temperature (° C.) | 17 |

In the simulation, the number of the recording element substrates 1 carried in the inkjet recording head 100 is set to nine, and the material of the support base 2 is silicon carbide (SiC). The shape of the recess used as the heat-transfer accelerating member 5 is a cube of which size is 500×500×500 micrometers, which is different from that illustrated in FIG. 2. The arrangement density of the heat-transfer accelerating members 5 in the first heat transfer portion 27 of the coolant flow channel 4 is set to 0.31 (pieces/$mm^2$). The arrangement density of the heat-transfer accelerating member 5 in the second heat transfer portion 28 of the coolant flow channel 4 is set to 0.09 (pieces/$mm^2$) in Example 2. Results of calculation in the simulation of Example 1, Example 2 and Comparative Example are illustrated in Table 2.

TABLE 2

| | Difference in temperature in the most downstream recording element substrate (° C.) | Difference in temperature within head (° C.) | The highest temperature in head (° C.) |
|---|---|---|---|
| Example 1 | 15.9 | 15.9 | 40.5 |
| Example 2 | 14.3 | 14.3 | 38.7 |
| Comparative Example | 16.5 | 16.5 | 41.0 |

Difference in temperature in the recording element substrate 1 in Table 2 is the difference in temperature in the recording element substrate 1 located at the most downstream of the ink supply channel 3. The recording element substrate 1 located at the most downstream of the ink supply channel 3, among the plural recording element substrates 1 arranged on the support base 2, is described as an example because the difference in temperature in that recording element substrate 1 tends to be large and a problem regarding deterioration in image quality tends to be caused.

As can be known from Table 2, in Example 1, the highest temperature in the head is lowered by 0.5° C. and the difference in temperature in the recording element substrate 1 is lowered by 0.6° C. as compared with Comparative Example. In Example 2, the highest temperature is lowered by 2.3° C., the difference in temperature in the head and the difference in temperature within the recording element substrate are lowered by 2.2° C. as compared with Comparative Example.

These results show that, if the arrangement density of the heat-transfer accelerating members 5 in the first heat transfer portion 27 is higher than that in the second heat transfer portion 28, the difference in temperature in the recording element substrate 1 may be reduced. Similarly, these results show that, if the heat-transfer accelerating members 5 are provided in the first heat transfer portion 27 whereas no heat-transfer accelerating member 5 is provided in the second heat transfer portion 28, the difference in temperature in the recording element substrate 1 may be reduced.

In Example 2, the highest temperature in the head and the difference in temperature in the recording element substrate 1 are smaller than those in Example 1. This is because the heat-transfer accelerating members 5 are provided also in the area other than the first heat transfer portion 27 including the second heat transfer portion 28 in Example 2 and, therefore, the heat transfer coefficient of the entire coolant flow channel 4 is higher than that of Example 1 and the highest temperature in the head is lowered. In Example 2, since the ink at the temperature lower than that in Example 1 flows into the recording element substrate 1, the increase in temperature of the recording element substrate 1 is further reduced and the difference in temperature in the recording element substrate 1 is smaller than Example 1.

As described above, the inkjet recording head 100 according to the present invention is capable of reducing the difference in temperature along the longitudinal direction within the recording element substrate 1 even if the amount of radiated heat from the recording element substrate 1 is large, such as during high speed printing. It is possible to set the highest temperature of the head 100 to be low and make the difference in temperature of the head 100 in the longitudinal direction be small. Therefore, image quality may be stable.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-148374 filed Jul. 4, 2011, which is hereby incorporated by reference herein in its entirety.

What is claimed is:

1. An inkjet recording head, comprising:

plural element substrates, each provided with an ejection port surface on which plural ejection ports are formed, through which ink is ejected, and plural energy generating elements which generate energy to eject the ink through the plural ejection ports; and a coolant flow channel provided on a rear surface side of the ejection port surface of the element substrates and in which a coolant, for cooling the plural element substrates, flows, the coolant flow channel including a first heat transfer portion and a second heat transfer portion, the first heat transfer portion being located on the side of the element substrates and overlapping in a direction vertical to the ejection port surface, a central portion of each of the element substrates in a direction in which the plural energy generating elements are arranged, and the second heat transfer portion being located on the side of the element substrates and overlapping in the direction vertical to the ejection port surface, an area between the plural element substrates which adjoin in the direction the plural energy generating elements are arranged, wherein the first heat transfer portion and the second heat transfer portion are provided with recesses toward a surface on the side of the element substrates, of a wall which forms the coolant flow channel, or projections protruding toward the surface of the wall on the side of the element substrates, and an arrangement density of the recesses or the projections provided in the first heat transfer portion being greater than an arrangement density of the recesses or the projections provided in the second heat transfer portion.

2. The inkjet recording head according to claim 1, wherein:

the coolant flow channel is provided with a winding portion; and in the second heat transfer portion, provided at a position near a downstream side of the winding portion, an arrangement density of the recesses or the projections in the outside of the winding portion is less than an arrangement density of the recesses or the projections in the inside of the winding portion.

3. The inkjet recording head according to claim 1, wherein:

the plural element substrates are arranged in a staggered pattern along the direction in which the plural energy generating elements are arranged; and the coolant flow channel is a single flow channel extending along the direction in which the plural energy generating elements are arranged, and the coolant flow channel intersects each of the element substrates at the central portion in the direction vertical to the ejection port surface and extends through the area between adjoining plural element substrates.

4. The inkjet recording head according to claim 3, further comprising an ink supply channel which supplies ink to the plural element substrates in an arranged order of the direction in which the plural energy generating elements are arranged, wherein, in the direction vertical to the ejection port surface, the coolant flows in the coolant flow channel such that the coolant intersects the plural element substrates at the central portion in an order opposite to the arranged order.

5. The inkjet recording head according to claim 1, wherein a third heat transfer portion, other than the first heat transfer portion and the second heat transfer portion, at a portion of the coolant flow channel provided on the side of the element substrates is also provided with the recesses or the projections.

6. The inkjet recording head according to claim 5, wherein in the third heat transfer portion, an arrangement density of the recesses or the projections in an upstream of the coolant flow channel in a direction in which the coolant flows is less than an arrangement density of the recesses or the projections downstream of the coolant flow channel in the direction in which the coolant flows.

7. An inkjet recording head, comprising:

plural element substrates, each provided with an ejection port surface on which plural ejection ports are formed, through which ink is ejected, and plural energy generating elements which generate energy to eject the ink through the plural ejection ports;

an ink supply channel which supplies ink to the plural element substrates in an arranged order of the direction in which the plural energy generating elements are arranged; and a coolant flow channel provided on a rear surface side of the ejection port surface of the element substrates and in which a coolant, for cooling the plural element substrates, flows, the coolant flow channel including a first heat transfer portion and a second heat transfer portion, the first heat transfer portion being located on the side of the element substrates and overlapping in a direction vertical to the ejection port surface, a central portion of each of the element substrates in a direction in which the plural energy generating elements are arranged, and the second heat transfer portion being located on the side of the element substrates and overlapping, in the direction vertical to the ejection port surface, an area between the plural element substrates which adjoin in the direction the plural energy generating elements are arranged, wherein the first heat transfer portion is provided with recesses toward a surface on the side of the element substrates, of a wall which forms the coolant flow channel or projections protruding toward the surface of the wall on the side of the element substrates, and the second heat transfer portion is not provided with the recess or the projection, and wherein the coolant flow channel is a single flow channel extending along the direction the plural energy generating elements are arranged, and the coolant flow channel intersects each of the element substrates at the central portion in the direction vertical to the ejection port surface and extends through the area between adjoining plural element substrates.

8. The inkjet recording head according to claim 7, wherein:

the plural element substrates are arranged in a staggered pattern along the direction in which the plural energy generating elements are arranged.

9. The inkjet recording head according to claim 8, wherein, in the direction vertical to the ejection port surface, the coolant flows in the coolant flow channel such that the coolant intersects the plural element substrates at the central portion in an order opposite to the arranged order.

* * * * *